US007057593B2

(12) United States Patent
Cho

(10) Patent No.: US 7,057,593 B2
(45) Date of Patent: Jun. 6, 2006

(54) LIQUID CRYSTAL DISPLAY

(75) Inventor: Bong-Hwan Cho, Gyunggi-do (KR)

(73) Assignee: Samsung Electronics Co., Ltd., Gyunggi-do (KR)

( * ) Notice: Subject to any disclaimer, the term of this patent is extended or adjusted under 35 U.S.C. 154(b) by 275 days.

(21) Appl. No.: 10/428,932

(22) Filed: May 5, 2003

(65) Prior Publication Data

US 2003/0222837 A1 Dec. 4, 2003

(30) Foreign Application Priority Data

May 30, 2002 (KR) ..... 10-2002-0030252

(51) Int. Cl.
*G09G 3/36* (2006.01)

(52) U.S. Cl. ..... 345/87; 345/77

(58) Field of Classification Search ..... 315/149, 315/169.3; 345/81, 87, 88, 90, 92, 98, 99, 345/100, 63, 72, 77, 78, 84, 102, 204; 348/673, 348/687
See application file for complete search history.

(56) References Cited

U.S. PATENT DOCUMENTS 6,256,833 B1 * 7/2001 Steinberg ..... 15/325
6,388,716 B1 * 5/2002 Tsuzuki et al. ..... 348/687
6,879,311 B1 * 4/2005 Sono ..... 345/94
2003/0107545 A1 * 6/2003 Harris et al. ..... 345/101
2003/0160753 A1 * 8/2003 McCartney ..... 345/99

FOREIGN PATENT DOCUMENTS

JP 2081092 3/1990
JP 02081092 A * 3/1990
JP 4104714 4/1992

* cited by examiner

*Primary Examiner*—Vijay Shankar
*Assistant Examiner*—Nitin Patel
(74) *Attorney, Agent, or Firm*—Sughrue Mion, PLLC

(57) ABSTRACT

A LSD (Liquid Crystal Display) apparatus includes an optical sensor for detecting an amount of light of the liquid crystal panel and a voltage setting unit for setting the voltage inputted to the pixels in relation to the amount of light detected by the optical sensor. Furthermore, the voltage setting unit includes a reference data storage unit for storing reference data for each color, a comparison unit for comparing the amount of light detected by the optical sensor with the reference data stored at the reference data storage unit, and a set voltage output unit for setting the voltage to be inputted to the pixels by calculating data compensating a difference between the values compared by the comparison unit. The amount of light of the liquid panel is detected to automatically adjust the voltage to be inputted to the liquid crystal panel in accordance with the amount of the light.

4 Claims, 4 Drawing Sheets

LIQUID CRYSTAL DISPLAY

BACKGROUND OF THE INVENTION

1. Field of the Invention

The present invention relates to a liquid crystal display apparatus, and more particularly to a LCD (Liquid Crystal Display) capable of automatically adjusting a driving voltage according to an amount of emitted light.

The present application is based on Korean Patent Application No. 2002-30252, filed May 30, 2002, which is incorporated herein by reference in its entirety 2. Background of the Related Art Recently, as mobile devices such as PDAs (Personal Digital Assistant), palm-top computers and cellular phones came into general use, LCOS (Liquid Crystal on Silicon) displays developed as microdisplay apparatuses for the mobile devices.

A color sequence of $R^+$(Red), $G^+$(Green), $B^+$(Blue), $W^+$(White), $R^-$(Red), $G^-$(Green), $B^-$(Blue), $W^-$(White) is displayed on a frame of the LCOS display in accordance with a predetermined timing.

Since transmittance characteristics are different with respect to different wavelengths of the R, G, B colors, an optimal voltage has to be set for each of the color wavelengths in order to optimize a color setting of the LCOS display.

Therefore, a different voltage of R+, G+, B+, Black+, White+, $R^-$(Red), $G^-$(Green), $B^-$(Blue), $W^-$(White) needs to be inputted to each frame.

The LCOS display needs individual power sources for normally black operation and for normally white operation.

FIG. 1 is a schematic diagram showing a circuit for generating a Vcom (Common Electrode Voltage) for a conventional LCOS display.

The circuit for generating the Vcom voltage comprises a power source unit 10, a multiplexer 20 and a buffer 30.

The power source unit 10 includes a plurality of adjustable resistors R1 to Rn corresponding to the individual power sources needed for the LCOS display. The adjustable resistors R1 to Rn are individually set to output different voltages ranging from −5.2V to 5.2V. The multiplexer 20 outputs the voltages inputted from the power source unit 10 to the buffer 30 in accordance with 4 bit selection signals a, b, c, and d.

In the conventional LCOS display, the Vcom voltage is adjusted by manually adjusting the plurality of adjustable resistors in accordance with a panel status. This is an inefficient process for image quality adjustment, and has lower precision as well as increased material cost.

SUMMARY OF THE INVENTION

An object of the invention is to solve at least the above problems and/or disadvantages and to provide at least the advantages described hereinafter.

Accordingly, one object of the present invention is to solve the foregoing problems by providing an LCD (Liquid Crystal Display) capable of automatically adjusting a driving voltage in accordance with an amount of emitted light.

The foregoing and other objects and advantages are realized by providing an LCD having a liquid crystal panel with a plurality of pixels inputting a different voltage with respect to each color, the LCD comprising: an optical sensor for detecting an amount of light of the liquid crystal panel; and a voltage setting unit for setting the voltage inputted to the pixels in relation to the amount of light detected by the optical sensor.

Further, the voltage setting unit comprises: a reference data storage unit for storing reference data for each color; a comparison unit for comparing the amount of light detected by the optical sensor with the reference data stored at the reference data storage unit; and a set voltage output unit for setting the voltage to be inputted to the pixels by calculating data for compensating a difference between the values compared by the comparison unit.

The LCD preferably further comprises a clamping unit for clamping the value detected by the optical sensor in a predetermined cycle.

It is preferable that the LCD further comprises a driver for outputting a color selection signal with respect to a color sequence, wherein the voltages set by the voltage setting unit are outputted in turn with respect to the color selection signals inputted from the driver.

Additional advantages, objects, and features of the invention will be set forth in part in the description which follows and in part will become apparent to those having ordinary skill in the art upon examination of the following or may be learned from practice of the invention. The objects and advantages of the invention may be realized and attained as particularly pointed out in the appended claims.

BRIEF DESCRIPTION OF THE DRAWINGS

The invention will be described in detail with reference to the following drawings in which like reference numerals refer to like elements wherein.

DETAILED DESCRIPTION OF PREFERRED EMBODIMENTS

The preferred embodiments of the invention will be hereinafter described in detail with reference to the accompanying drawings.

Figure 1:
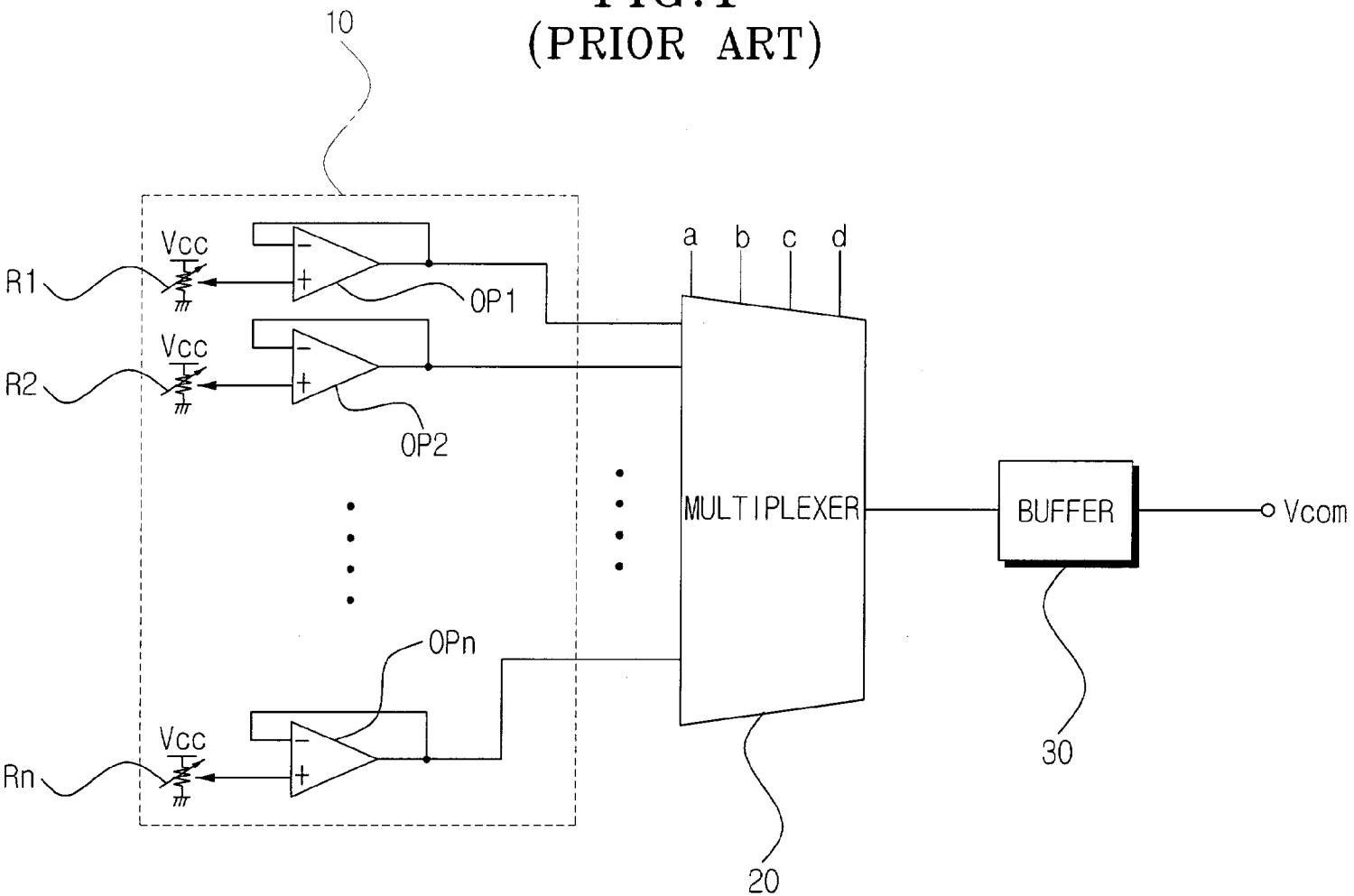
FIG. 1 (PRIOR ART)
FIG. 1 is a schematic diagram showing a circuit for generating a driving voltage for a conventional LCOS display.
Figure 2:
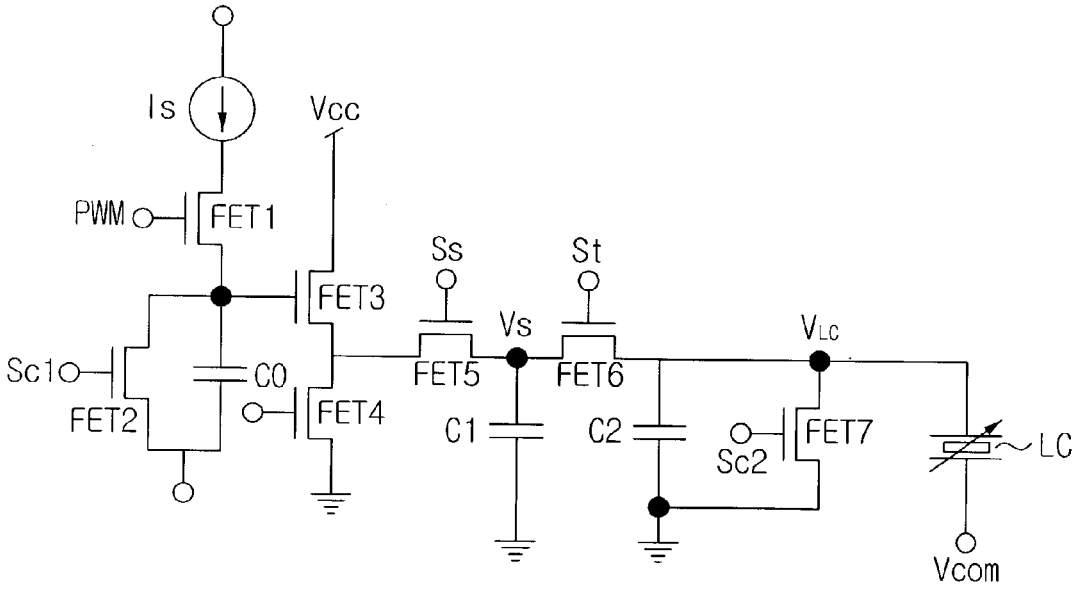
FIG. 2 is a schematic diagram of a unit pixel of a general LCOS display.

FIG. 2 is a schematic diagram of a unit pixel of a general LCOS display.

The LCOS display has unit pixels, as shown in FIG. 2, arrayed in a 1408×884 matrix structure.

In each of the unit pixels, a PWM (Pulse-Width Modulated) voltage generates a PWM waveform according to a pixel value (8-bit data) by switching current from a power source Is through a transistor FET1.

Each of the unit pixels comprises a plurality of transistors and capacitors, and needs a voltage to drive the transistors and to charge and discharge the capacitors.

A reference mark Ss is a voltage for charging an input image to capacitor C1 through scanning of the pixels by row.

Sc1 is a voltage for discharging capacitors C0 and C1 to prepare to scan a next row of pixels after completing a digital to analog conversion for a current row.

Sc2 is a voltage for discharging a voltage applied to capacitor C2 before a next frame is transmitted after a current frame is displayed.

Figure 3:
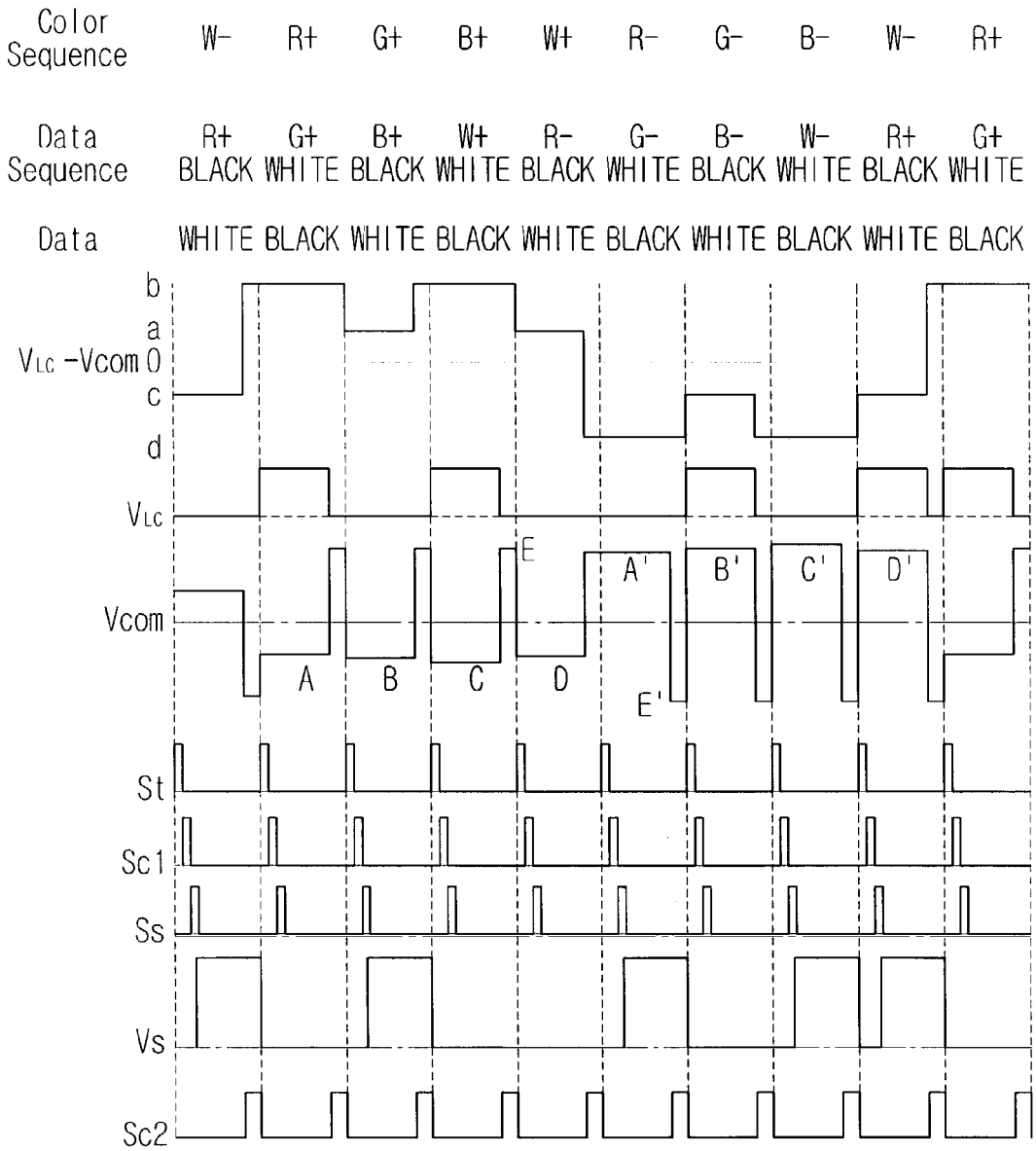
FIG. 3 is a diagram showing timing sequences of voltages needed for the LCOS display.

FIG. 3 is a diagram showing timing sequences of voltages needed for the LCOS display.

Hereinafter, the operation of a unit pixel will be described with reference to FIGS. 2 and 3.

For a positive frame (+frame), a digital to analog conversion is performed in each pixel to charge an input image to C1 in relation with Ss, and the input image is charged with respect to all rows, and then Sc2 is turned on to discharge a liquid crystal voltage $V_{LC}$ of each pixel of the previous frame displayed.

Next, St is turned on so that the whole image data is transmitted, and thus the liquid crystal voltage of the current frame is applied.

For a negative frame (−frame), a digital to analog conversion is performed in each pixel with respect to inverted image data to charge an input image to C1 in relation with Ss, and the input image is charged with respect to all rows, and then Sc2 is turned on to discharge a liquid crystal voltage $V_{LC}$ of each pixel of the previous frame displayed.

Next, St is turned on so that the whole image data is transmitted and thus the liquid crystal voltage of the current frame is applied.

A Vcom voltage will be described with reference to FIG. 3.

The Vcom voltage is also called the ITO (Indium Tin Oxide) voltage, and needs to be precise to display black or white exactly on a panel.

A Vcom voltage is applied in correspondence with the + or −frame as shown in FIG. 3, and driven by alternating current to prevent sticking phenomenon of the LC (Liquid Crystal) panel. A voltage of $V_{LC}$−Vcom is actually applied to each pixel of the LC panel.

As shown in FIG. 3, the Vcom voltage needs a plurality of individual voltages such as A, B, C, D, E, A', B', C', D', E'.

These individual voltages are needed to display R+, G+, B+, Black+, White+, R−, G−, B−, Black−, White−, respectively.

In a normally black mode, A=−0.8V, B=−2.0V, C=−2.2V, D=−1.9V, E=5.0V while A'=4.8V, B'=5.0V, C'=5.2V, D'=4.9V, E'=−5.0V.

R+, G+, B+, Black+, White+ are respectively inverted voltages of R−, G−, B−, Black−, White−.

Figure 4:
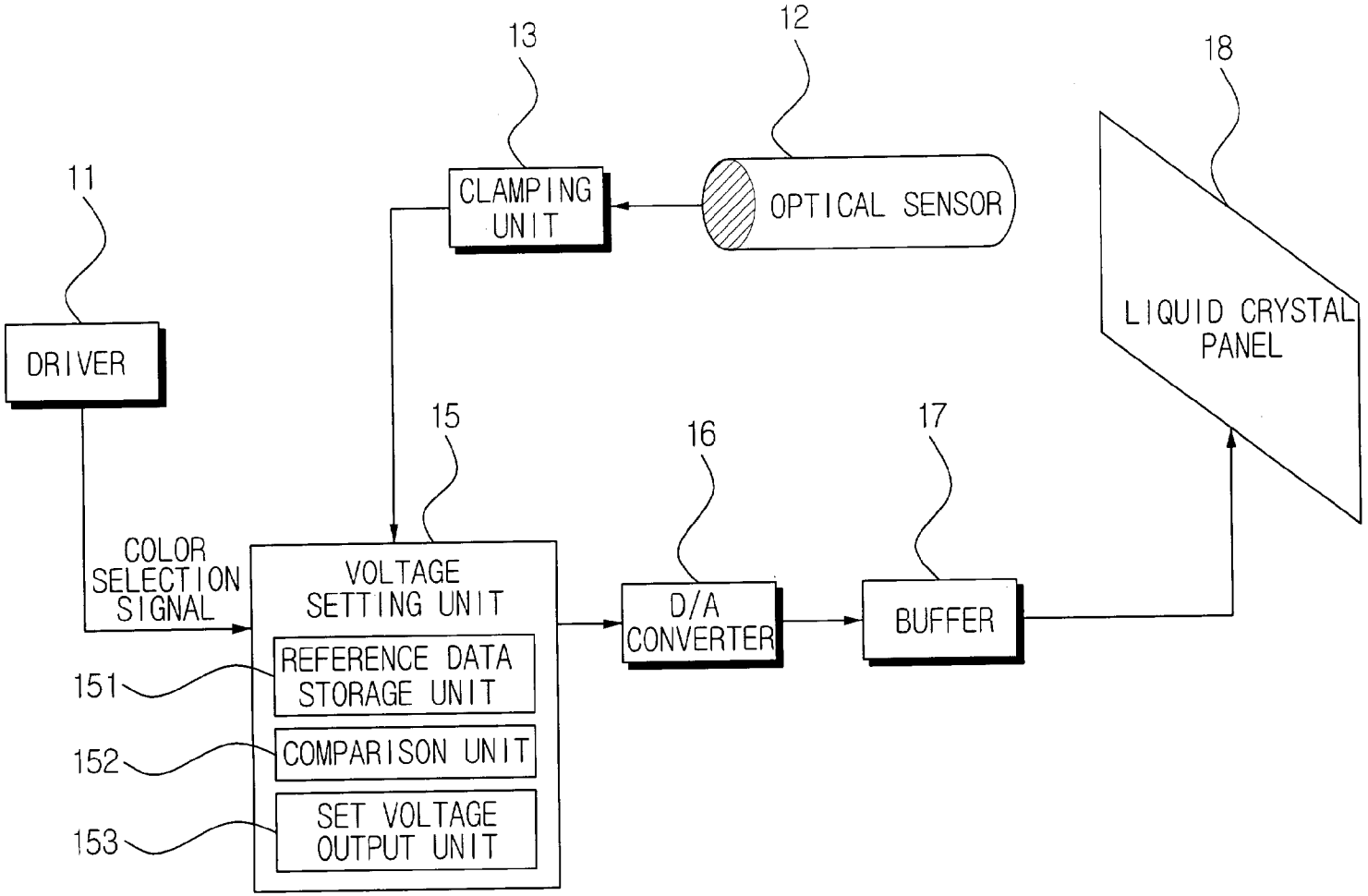
FIG. 4 is a block diagram of an LCD according to the invention.

FIG. 4 is a block diagram of a microdisplay apparatus according to the invention.

The microdisplay apparatus comprises a driver 11, an optical sensor 12, a clamping unit 13, voltage setting unit 15, a D/A converter 16, a buffer 17 and a liquid crystal panel 18.

The driver 11 transmits a color selection signal to the voltage setting unit 15 with respect to a color sequence of $R^+$, $G^+$, $B^+$, $W^+$, $R^-$, $G^-$, $B^-$, $W^-$.

The optical sensor 12 measures a luminance of the liquid crystal panel 18 to transmit the measured luminance value to the clamping unit 13.

Generally, 8 frames are processed during one vertical synchronizing period (1/60 second), and 8 color sequences are processed in one frame.

Therefore, the clamping unit 13 clamps the input luminance value in an about 0.2 ms time period to generate a direct current value of the luminance value with respect to an image signal of the liquid crystal panel 18 and output the value to the voltage setting unit 15.

The voltage setting unit 15 generally comprises a microcomputer, and sets an optimal Vcom voltage to be applied to the pixels of the liquid crystal panel in relation to the luminance value of the input image signal from the clamping unit 13 and the color selection signal input from the driver 11.

The voltage setting unit 15 comprises a reference data storage unit 151, a comparison unit 152 and a set voltage output unit 153.

The reference data storage unit 151 stores reference data for each color.

The comparison unit 152 compares the reference data stored at the reference data storage unit 151 with a luminance value of light detected by the optical sensor 12.

The set voltage output unit 153 sets a voltage to be applied to the pixel by computing data for compensating the difference between the values compared by the comparison unit 152.

For example, when a gray level stored at the reference data storage unit 151, which corresponds to the color according to the color selection signal from the driver 11, is 128 and the output value from the clamping unit 13 is 200, the image is brighter than a color currently to be displayed, thus a low voltage is outputted.

Further, the calculated optimal Vcom voltage is outputted to the D/A converter 16.

The D/A converter 16 converts the input signal, and the D/A converted signal outputted from the D/A converter 16 is stored in the buffer to be output to the liquid crystal panel 18.

According to the LCD of the present invention, an amount of light from the liquid crystal panel is detected to adjust a voltage applied to the liquid crystal panel in accordance with the detected amount of light, thus enabling the automatic adjustment of the driving voltage.

Furthermore, the adjustable resistors, which are needed in the prior art, are not necessary so that the LCD can be manufactured at a lower price.

An image quality adjustment can be done without manually processing the adjustment during mass production, thereby allowing effective and fast mass production.

While the invention has been shown and described with reference to certain preferred embodiments thereof, it will be understood by those skilled in the art that various changes in form and details may be made therein without departing from the spirit and scope of the invention as defined by the appended claims.

The foregoing embodiments and advantages are merely exemplary and are not to be construed as limiting the present invention. The present teaching can be readily applied to other types of apparatuses. The description of the present invention is intended to be illustrative, and not to limit the scope of the claims. Many alternatives, modifications, and variations will be apparent to those skilled in the art. In the claims, means-plus-function clauses are intended to cover the structures described herein as performing the recited function and not only structural equivalents but also equivalent structures.

What is claimed is:

1. A liquid crystal display having a liquid crystal panel with a plurality of pixels inputting a different voltage with respect to each of a plurality of colors, the LCD comprising:

an optical sensor for detecting an amount of light of the liquid crystal panel; and a voltage setting unit for setting the voltage inputted to the pixels in relation to the amount of light detected by the optical sensor;

wherein the voltage setting unit comprises: a reference data storage unit for storing reference data for each of the colors;

a comparison unit for comparing the amount of light detected by the optical sensor with the reference data stored at the reference data storage unit; and a set voltage output unit for setting the voltage to be inputted to the pixels by calculating data for compensating a difference between the values compared by the comparison unit.

2. The LCD according to claim 1, further comprising a clamping unit for clamping a value of the amount of light of the liquid crystal panel detected by the optical sensor in a predetermined cycle.

3. The LCD according to claim 1, further comprising a driver for outputting a color selection signal with respect to a color sequence, wherein the voltages set by the voltage setting unit are outputted in turn with respect to the color selection signals inputted from the driver.

4. A liquid crystal display having a liquid crystal panel with a plurality of pixels inputting a different voltage with respect to each of a plurality of colors, the LCD comprising:

an optical sensor for detecting an amount of light of the liquid crystal panel; and a voltage setting unit for setting the voltage inputted to the pixels in relation to the amount of light detected by the optical sensor;

wherein the voltage setting unit comprises: a reference data storage unit for storing reference data for each of the colors;

a comparison unit for comparing the amount of light detected by the optical sensor with the reference data stored at the reference data storage unit; and a set voltage output unit for setting the voltage to be inputted to the pixels by calculating data for compensating a difference between the values compared by the comparison unit.

* * * * *